United States Patent [19]

Okamoto et al.

[11] 4,326,148

[45] Apr. 20, 1982

[54] GAS DISCHARGE DISPLAY DEVICE

[75] Inventors: Takio Okamoto, Kusatsu; Tamisuke Atsumi, Kobe; Yoshio Nakagawa, Otsu; Hidezo Akutsu, Kobe, all of Japan

[73] Assignee: Matsushita Electronics Corporation, Kadoma, Japan

[21] Appl. No.: 56,307

[22] Filed: Jul. 10, 1979

[30] Foreign Application Priority Data

Jul. 14, 1978 [JP] Japan ..... 53-86468

[51] Int. Cl.[3] ..... H01Q 13/10

[52] U.S. Cl. ..... 315/169.2; 315/169.4; 340/770

[58] Field of Search ..... 315/169.4, 169.2; 340/768, 770

[56] References Cited

U.S. PATENT DOCUMENTS 3,631,530 12/1971 Ogle ..... 340/758

3,820,107 6/1974 Niizawa ..... 340/758

*Primary Examiner*—Harold A. Dixon

*Attorney, Agent, or Firm*—Cushman, Darby & Cushman

[57] ABSTRACT

In a gas discharge display device comprising a number of parallel array of anodes and crosswide disposed parallel array of cathodes, the anodes and cathodes being disposed with small discharging gaps filled with gas inbetween thereby forming a gas discharging matrix, on which a discharging spot scans from one end to the other end of the cathode of the array, wherein the array of the cathode is divided into plural divided arrays each having substantially the same number of cathodes and respective cathodes of the divided arrays are connected in common to respective cathodes of other divided arrays, the improvement is that any cathodes neighboring each other in one of the divided arrays are connected to such cathodes in other divided arrays as those are other than each other neighboring cathodes.

3 Claims, 10 Drawing Figures

GAS DISCHARGE DISPLAY DEVICE

BACKGROUND OF THE INVENTION

1. Field of the Invention

The present invention relates to gas discharge display devices, especially to those utilizing D.C. type gas discharging.

2. Description of the Prior Art

Among D.C. type gas-discharge display devices, a typical known one is the gas discharge display device of the Burroughs type which utilizes so-called self-scanning. As shown in FIG. 1, the abovementioned self-scanning type gas discharge display device comprises a vertical array of parallel cathodes $K_1$, $K_2$, . . . , a horizontal array of parallel anodes $A_1$, $A_2$, . . . for displaying and scanning anodes $S_1$, $S_2$, . . . which are disposed in parallel to the displaying anodes $A_1$, $A_2$, . . . , wherein the cathodes $K_1$, $K_2$, . . . are disposed crosswise to the anodes $A_1$, $A_2$, . . . and $S_1$, $S_2$, . . . forming small discharge gaps inbetween. The cathodes $K_1$, $K_2$, . . . are divided into several divided parts, for example, a first part of $K_1$ to $K_5$, a second part of $K_6$ to $K_{10}$, a third part of $K_{11}$ to $K_{15}$ and so on, as shown in FIG. 1. The cathodes of the corresponding order in the divided parts are connected in common, thereby forming a group of a first phase cathode $K\phi_1$, a group of a second phase cathodes $K\phi_2$, . . . . The abovementioned self-scanning type gas discharge display device is operated by applying cyclic pulse signals $K\phi_1$, $K\phi_2$, . . . having timings as shown in FIG. 2 to the groups of respective phase cathodes $K\phi_1$, $K\phi_2$, . . . . By application of such cyclic signals to the cathode groups, scanning glow discharge is sequentially transferred along a selected one scanning anode ($S_1$ or $S_2$, . . . ) from a starting cathode $K_R$ to the cathode $K_1$ and sequentially thereafter, through $K_2$, . . . $K_5$, $K_6$, . . . $K_{10}$, $K_{11}$, . . . $K_{15}$, . . . . By application of a display voltage signal to a selected display anode during the time period when the pulse signal to form the small glow discharge is impressed on a selected cathode, a display with a display glow discharging is made at the cross point of the selected display anode and the selected cathode.

The gas discharge display device of the abovementioned conventional type has an advantage that an electronic circuit for the scanning of the cathode can be made simple, since the array of cathodes is divided into several divided arrays. However, on the other hand, the abovementioned conventional device has such a grave problem of a possibility of erroneous scanning. Such erroneous scanning is likely to happen in a manner that the scanning glow discharging erroneously is transferred, instead of to the next position, to an apart position, the cathode of which belongs to the same phase of cathodes. The abovementioned erroneous scanning results in very unstable operation and hence fatal erroneous displaying.

SUMMARY OF THE INVENTION

The object of the present invention is to provide an improvement in a gas discharge display device capable of stable scanning by adopting a novel connection of the cathodes.

The present invention particularly concerns an improvement in a gas discharge display device wherein scanning of the cathodes, namely sequential transferring of scanning glow discharging is very stable even for a very small discharge current for the scanning glow.

BRIEF DESCRIPTION OF THE DRAWING

FIG. 5(*b*) is a time chart showing pulse signals to be applied to the respective groups of common connected cathodes $K\phi_1$, $K\phi_2$, . . . of FIG. (*a*).

FIG. 6(*b*) is a time chart showing pulse signals to be applied to the respective groups of common connected cathodes $K\phi_1$, $K\phi_2$, . . . of FIG. 6(*a*).

FIG. 8(*b*) is a time chart showing waveforms of the circuit of FIG. 8(*a*).

DESCRIPTION OF THE PREFERRED EMBODIMENT

The present inventors examined the cause of erroneous scanning of the smaller glow discharges, and found the following:

The main cause of the erroneous scanning is an undesirable branch discharge current which flows through another cathode belonging to the group of the cathode of the same phase as that being scanned, thereby producing an undesirable glow discharge at the another cathode. Namely, when such branch discharge current flows to a certain apart cathode, a cathode following thereto becomes liable to a discharging, and therefore sometimes the scanning happens to follow the abovementioned certain apart cathode instead of the right cathode under the scanning, thus making an erroneous scanning.

The inventors have made detailed studies concerning the relation between the branch discharging current and the erroneous scanning, and found a novel construction of a device, capable of preventing such erroneous scanning even for the case of occurrence of branch discharge current at a common connected other cathode. Thereby, a very stable scanning is attained even for a very small scanning discharge current.

The novel gas discharge display device of the present invention comprises an array of a number of parallel disposed anodes and an array of parallel disposed cathodes, the anodes and cathodes being disposed crosswise with small discharging gaps filled with gas inbetween thereby forming a gas discharging matrix having a number of gas discharging cells thereon at cross points of the anodes and the cathodes, whereon a discharging spot scans from a gas discharging cell on one end to the other end by being transferred sequentially from one discharge cell to the next one, wherein the cathodes are divided into plural divided parts which are disposed from one side to the other side of the cathode array, and respective ones of cathodes of the divided parts are connected in common, thereby forming plural groups of common connection of cathodes, and the improvement is that said common connection is made in such a manner that there is no more than one pair of cathodes neighboring each other between two groups arbitrarily selected out of said plural groups of common connection of cathodes, so that no sequential scanning voltage is supplied to other pairs than the abovementioned one pair of the cathodes neighboring each other.

The present invention is hereinafter elucidated in detail referring to the accompanying drawings.

Experiments made by the inventors are elucidated as follows.

Figure 1:
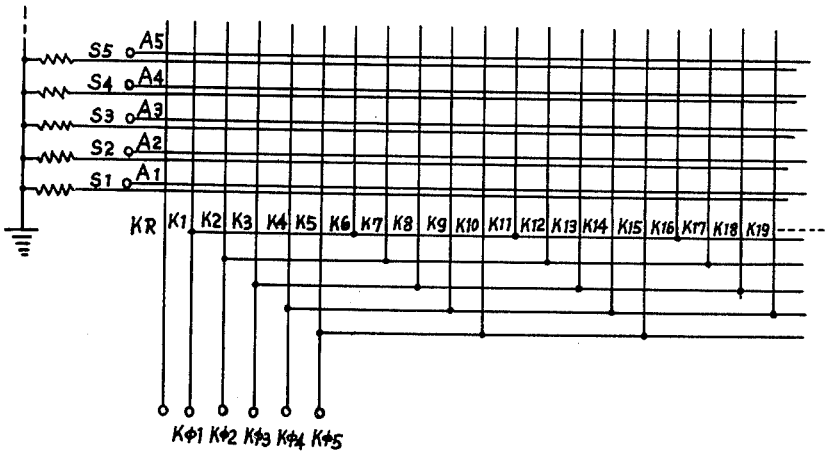
FIG. 1 is a schematic front view of a conventional self scanning type (so-called Burroughs type) gas discharge display device.
Figure 2:
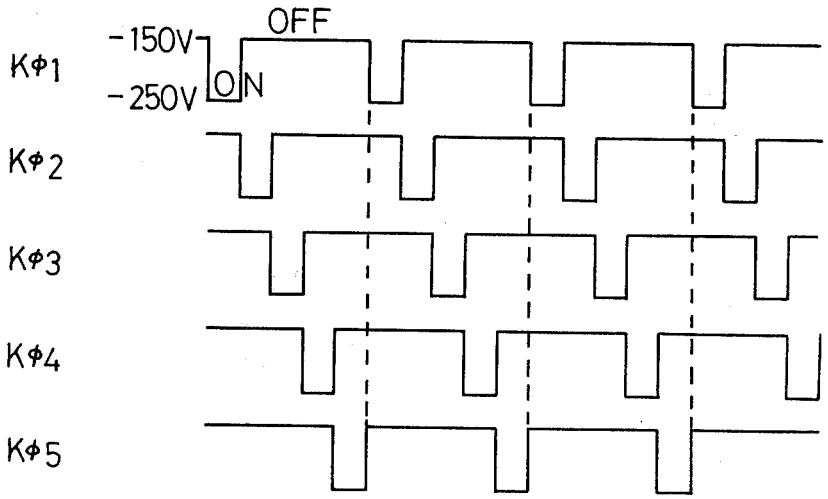
FIG. 2 is a time chart showing pulse signals to be applied to the respective groups of phases of cathodes $K\phi_1$, $K\phi_2$, . . . of FIG. 2.

Firstly, a known Burroughs type gas discharge display device is made with the construction and operation as shown in FIG. 1 and FIG. 2 and details as shown in the following Table 1.

TABLE 1

| (Conventional Burroughs type) | |
|---|---|
| number of cathodes | 96 (divided into 16 common connected cathode groups |
| number of display anode | 36 |
| number of scanning anode | 36 |
| pitch of the discharge dots | 1.27 mm |
| discharge gaps between cathode and anodes | 0.4 mm |
| discharge gas | (Ne + 0.2% Xe), 200 Torr. |
| color of display light | orange |
| ignition voltage between anode and cathode | 250 V |
| display discharge current | 0.8 mA |
| discharge sustain voltage | 150 V |
| brightness of displaying | about 50 fL |
| duty for scanning in display discharging | $\frac{1}{100}$ |

In the known device shown in FIG. 1 and FIG. 2, the array of cathodes are divided into several divided parts, each parts including five cathodes. Namely, cathodes $K_1$ to $K_5$ form a first part, $K_6$ to $K_{10}$ a second part, $K_{11}$ to $K_{15}$ a third part, etc. The connection of the known device is made in such a manner that the cathodes of corresponding order of disposition in the divided parts are connected in common each other. Namely, every first cathodes in respective divided parts are connected in common thereby forming a first phase group $K\phi_1$, every second cathodes in respective divided parts are connected in common thereby forming a second phase group $K\phi_2$, every third cathodes connected in common forming a third phase group, every fourth cathodes connected in common forming a fourth phase group, and so on. Namely, the cathodes are divided into several divided parts which are disposed from one side to the other side of the cathode array; and on the other hand, the cathodes are divided into several groups of common-connection, wherein common connection is made in the manner that cathodes of corresponding order of disposition in the divided parts are connected in common. As shown in FIG. 2, pulse signals of the same sequential order are impressed on the phase groups of the cathodes of the corresponding sequential order, respectively.

In the operation of the abovementioned conventional gas discharge display device, irrespective of the number of the phase groups, erroneous scanning occurs. Especially for scanning glow discharge currents under 0.4 mA, such erroneous scanning occurs often.

Figure 5:
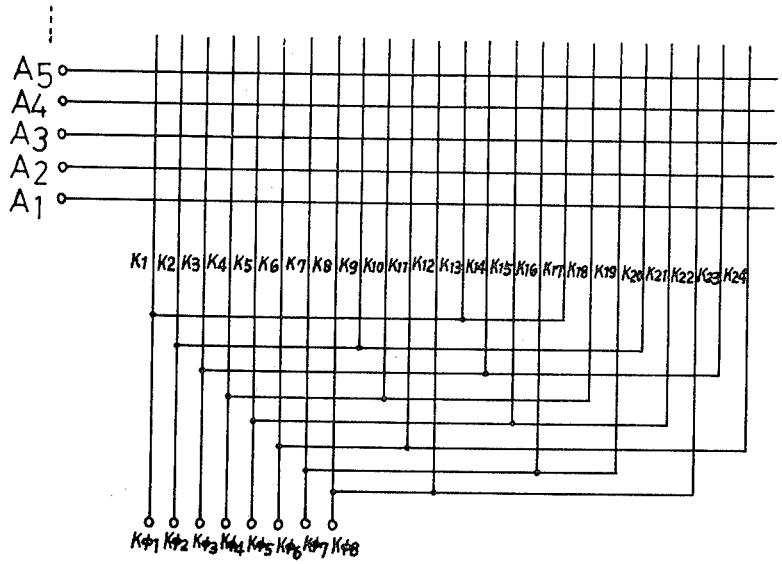
FIG. 5(*a*) is a schematic front view showing connection of cathodes of a first example of the present invention.
Figure 5:
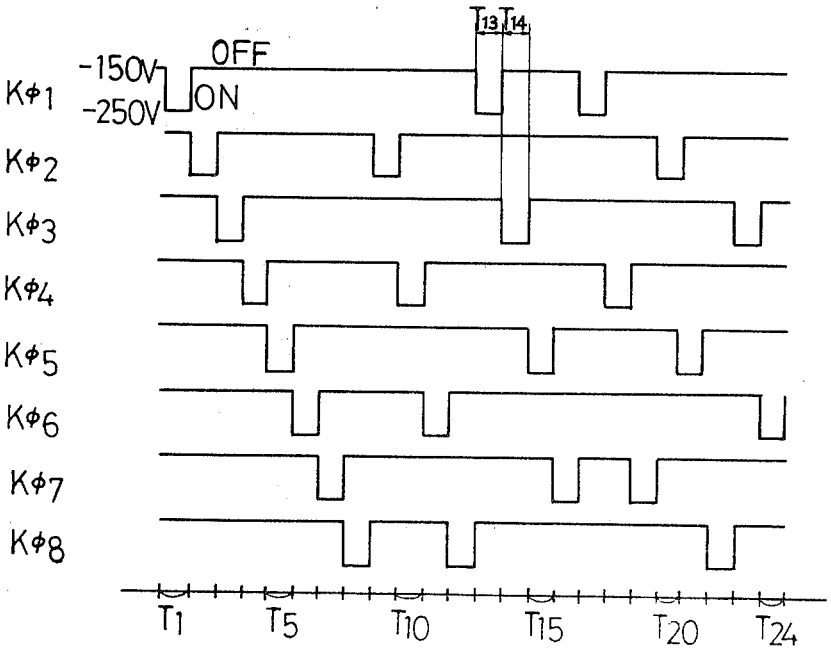

On the other hand, in an improved device in accordance with the present invention as shown in FIG. 5, when operated at similar condition as those of Table 1, such erroneous scanning does not occur even for a scanning discharge currents under 0.4 mA.

In the following, construction and way of operation of the device of FIG. 5 is elucidated in detail.

The principle or gist of the present invention is to construct the device in such a manner that, even when the undesirable branch current flows and hence an undesirable glow discharge occurs in an erroneous discharging cell including a cathode commonly connected to the right cathode, an undesirable transferring of the erroneous glow discharge is prevented. Namely, according to the present invention, such branch current does not trigger an erroneous scanning therefrom. Let us take an example that, during a cathode scanning time period $T_{13}$ when a proper scanning glow discharge is made at the cathode $K_{13}$ belonging to a first common connected cathode group $K\phi_1$, an erroneous branch discharge current happens to flows through a cathode $K_1$, of the same group $K\phi_1$. In such case, due to specially arranged connections of the cathodes in the common connection groups in accordance with the present invention, in the next cathode scanning time period $T_{14}$, the scanning pulse is impressed to a proper next cathode $K_{14}$ belonging to a third common connected cathode group $K\phi_3$. In the neighboring position of the cathode $K_1$, there is no cathode which is common connected to the cathode $K_{14}$. Namely, no scanning pulse is impressed to the neighboring cathode $K_2$ in the time period $T_{14}$.

In the example of FIG. 5, the array of cathodes is divided into eight common connected cathode groups $K\phi_1$ to $K\phi_8$, and the scanning signal pulses are impressed on respective common connected cathode groups $K\phi_1$ to $K\phi_8$ in the following timing table of Table 2:

TABLE 2

| | | | | | | | | | |
|---|---|---|---|---|---|---|---|---|---|
| In | $T_1$, | $T_2$, | $T_3$, | $T_4$, | $T_5$, | $T_6$, | $T_7$ | and | $T_8$, |
| On | $K\phi_1$, | $K\phi_2$, | $K\phi_3$, | $K\phi_4$, | $K\phi_5$, | $K\phi_6$, | $K\phi_7$ | and | $K\phi_8$, |
| respectively. | | | | | | | | | |
| In | $T_9$, | $T_{10}$, | $T_{11}$, | $T_{12}$, | $T_{13}$, | $T_{14}$, | $T_{15}$ | and | $T_{16}$, |
| On | $K\phi_2$, | $K\phi_4$, | $K\phi_6$, | $K\phi_8$, | $K\phi_1$, | $K\phi_3$, | $K\phi_5$ | and | $K\phi_{17}$, |
| respectively. | | | | | | | | | |
| In | $T_{17}$, | $T_{18}$, | $T_{19}$, | $T_{20}$, | $T_{21}$, | $T_{22}$, | $T_{23}$ | and | $T_{24}$, |
| On | $K\phi_1$, | $K\phi_4$, | $K\phi_7$, | $K\phi_2$, | $K\phi_5$, | $K\phi_8$, | $K\phi_3$ | and | $K\phi_6$, |
| respectively. | | | | | | | | | |

As seen from the abovementioned Table 2, in the impressings of the scanning pulse signals to the common connected cathode groups, the sequential impressings of scanning signals on sequentially neighboring cathodes are made only:

on cathodes $K_1$ to $K_8$ during the time periods of $T_1$ to $T_8$, on cathodes $K_9$ to $K_{16}$ during the time periods of $T_9$ to $T_{16}$, and on cathodes $K_{17}$ to $K_{24}$ during the time periods of $T_{17}$ to $T_{24}$, respectively. In other words, in general, the condition in accordance with the present invention of the impressings of the scanning pulse on the common connected cathode groups is that, in one cycle of scanning of all cathodes, fully sequential impressings of the scanning signals on the common connected cathode groups takes place no more than once.

Such condition can be obtained by connecting the common connection in such a manner that there is no more than one pair of cathodes neighboring each other between two groups arbitrarily selected out of said plural groups of common connection of cathodes. In other words, the connection can be defined that any cathodes neighboring each other in one of the divided parts (for example, the first part of $K_1$ to $K_8$, the second part of $K_9$ to $K_{16}$, the third part of $K_{17}$ to $K_{24}$ in FIG. 5) are connected to such cathodes of other divided parts as those are not neighboring each other.

Figure 6:
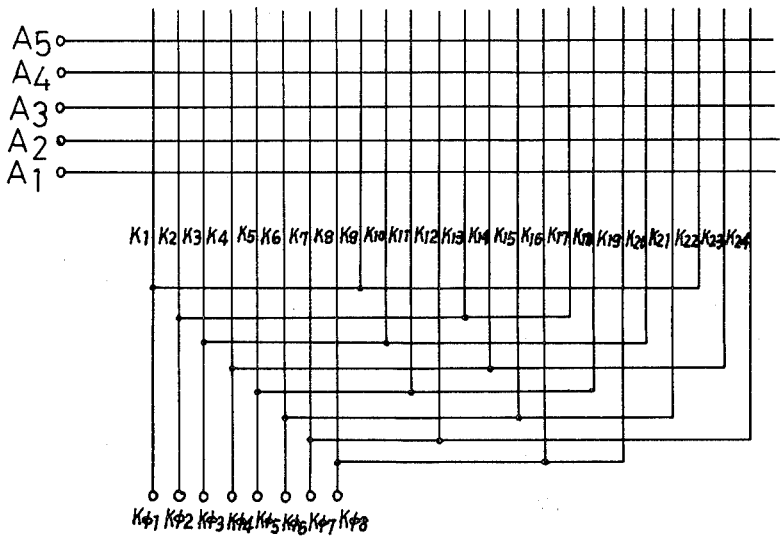
FIG. 6(*a*) is a schematic front view showing connection of cathodes of a second example of the present invention.
Figure 6:
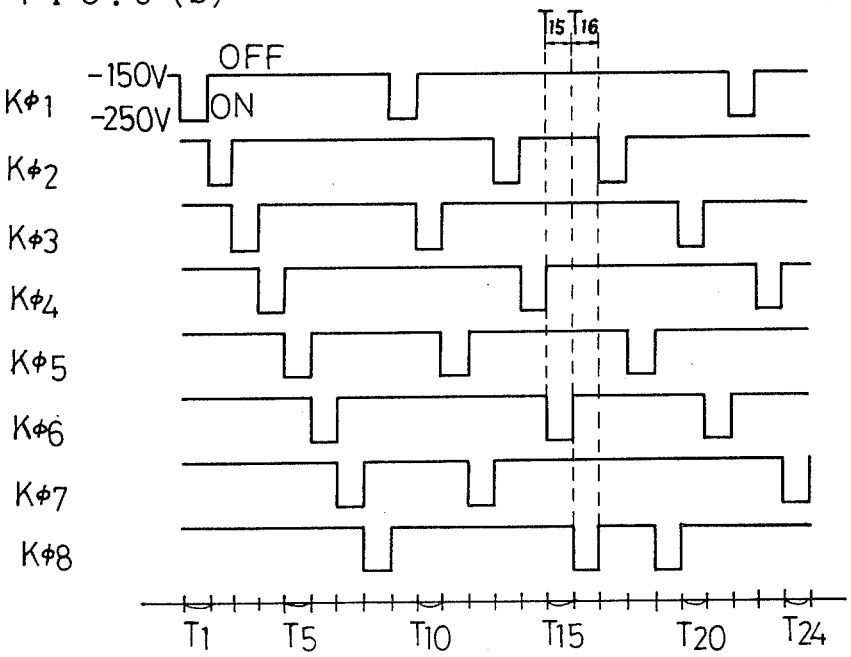

Another example of the construction in accordance with the present invention to fulfill the abovementioned condition is shown in FIG. 6. Let us take an example that during a cathode scanning time period $T_{15}$ when a proper scanning glow discharge is made at the cathode $K_{15}$ belonging to a sixth common connected cathode group $K\phi_6$, an erroneous branch discharge current flows through a cathode $K_6$ of the same group $K\phi_6$. In such case, because of the specially arranged connections of the cathodes in the common connection groups in accordance with the present invention, in the next cathode scanning time period $T_{16}$ the scanning pulse is impressed to a proper next cathode $K_{16}$ belonging to an eighth common connected cathode group $K\phi_8$. In the neighbor position of the cathode $K_6$, there is no cathode which is common connected to the cathode $K_{16}$. Namely, no scanning pulse is impressed to the neighboring cathode $K_7$ in the time period $T_{16}$.

In the example of FIG. 6, the array of cathodes is divided into eight common connected cathode groups $K\phi_1$ to $K\phi_8$, and the scanning signal pulses are impressed on respective common connected cathode groups $K\phi_1$ to $K\phi_8$ in the following timing table of Table 3:

TABLE 3

| | | | | | | | | | |
|---|---|---|---|---|---|---|---|---|---|
| In | $T_1$, | $T_2$, | $T_3$, | $T_4$, | $T_5$, | $T_6$, | $T_7$ | and | $T_8$, |
| On | $K\phi_1$, | $K\phi_2$, | $K\phi_3$, | $K\phi_4$, | $K\phi_6$, | $K\phi_7$ | and | $K\phi_8$, | |
| respectively. | | | | | | | | | |
| In | $T_9$, | $T_{10}$, | $T_{11}$, | $T_{12}$, | $T_{13}$, | $T_{14}$, | $T_{15}$ | and | $T_{16}$. |
| On | $K\phi_1$, | $K\phi_3$, | $K\phi_5$, | $K\phi_7$, | $K\phi_7$, | $K\phi_4$, | $L\phi_6$ | and | $K\phi_8$, |
| respectively. | | | | | | | | | |
| In | $T_{17}$, | $T_{18}$, | $T_{19}$, | $T_{20}$, | $T_{21}$, | $T_{22}$, | $T_{23}$ | and | $T_{24}$. |
| On | $K\phi_2$, | $K\phi_5$, | $K\phi_8$, | $K\phi_3$, | $K\phi_6$, | $K\phi_1$, | $K\phi_4$ | and | $K\phi_7$, |
| respectively. | | | | | | | | | |

As seen from the abovementioned Table 3, the impressings of the scanning pulse signals to the common connected cathode groups is such that, in one cycle of scanning of all the cathodes, fully sequential impressings of the scanning signals on the common connected cathode groups takes place no more than once.

In order to obtain the abovementioned condition elucidated referring to figures of the present invention, the maximum number Kmax of cathode capable of being scanned is given as follows for number N of cathodes:

$$\text{for } N \text{ of odd number: } \frac{N(N-1)}{2} < K\max < \frac{N(N+1)}{2} \quad (1)$$

$$\text{for } N \text{ of even number: } \frac{N(N-2)}{2} < K\max < \frac{N^2}{2}. \quad (2)$$

An experimental device is made by utilizing a conventional Burroughs type device having constructional and operational details shown in Table 1. The experimental device has the cathode connection in similar manner to those of FIG. 5 and FIG. 6 but has sixteen common connected cathode groups $K\phi_1$ to $K\phi_{16}$. The experimental device shows a very stable scanning (making no erroneous scanning) even for a low scanning glow discharge current of 0.1 mA.

Figure 7:
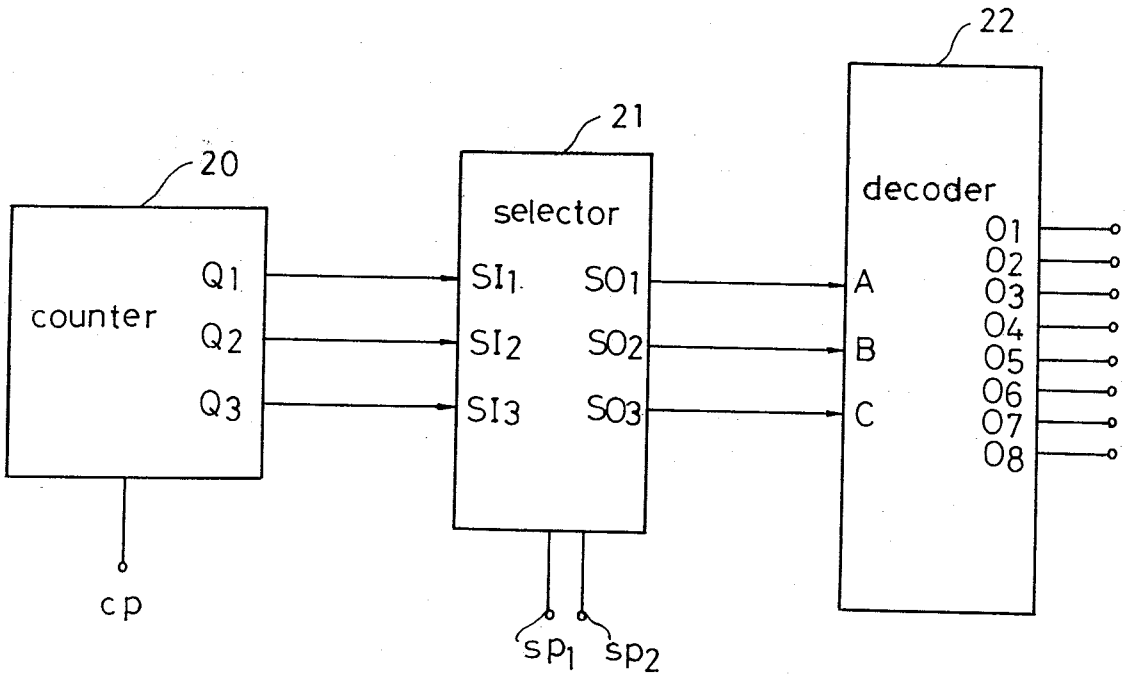
FIG. 7 is a circuit diagram of a scanning signal source for generating a scanning signal to be applied to the respective groups of common connected cathodes.

Hereupon, the scanning voltage signal to be impressed on the common connected cathode groups is produced by the circuit of FIG. 7. Namely, the output signals from three output terminals $Q_1$, $Q_2$ and $Q_3$ of a known binary counter 20 is selectively impressed on three input terminals A, B and C of a known decoder 22 by means of selecting work of a known selector 21. In case of the conventional device of FIG. 1, there is no need of such selector 21, since the scanning is repeated in the same order as shown in FIG. 2. However, in the present invention, in order to obtain a predetermined order of impressing of pulses to the common connected cathode groups, the selector 21 is inserted between the counter 20 and the decoder 22. In this example, the selector 21 has three input terminals $SI_1$, $SI_2$ and $SI_3$, three output terminals $SO_1$, $SO_2$ and $SO_3$, and two selection signal input terminals $SP_1$ and $SP_2$, and works to interchange connections between the output terminals $Q_1$, $Q_2$ and $Q_3$ of the counter 20 to the input terminals A, B and C of the decoder 22, for example in the following manner:

In the impressings of a first group of eight pulses in the time period of $T_1$ to $T_8$ of FIG. 5(*b*), the connections are:

from the output terminal $Q_1$ to the input terminal A,
from the output terminal $Q_2$ to the input terminal B, and
from the output terminal $Q_3$ to the input terminal C.

In the impressings of a second group of eight pulses in the time period of $T_9$ to $T_{16}$ of FIG. 5(*b*), the connections are:

from the output terminal $Q_1$ to the input terminal B,
from the output terminal $Q_2$ to the input terminal C, and
from the output terminal $Q_3$ to the input terminal A.

And in the impressings of a third group of eight pulses in the time period of $T_{17}$ to $T_{24}$ of FIG. 5(*c*), the connections are:

from the output terminal $Q_1$ to the input terminal A,
from the output terminal $Q_2$ to the input terminal C, and
from the output terminal $Q_3$ to the input terminal B.

By such interchanging of the connections by the selector 21, order of pulses to be impressed on the common connected cathode groups $K\phi_1$ to $K\phi_8$ are arranged as shown in FIG. 5(*b*). If a gas discharge display device comprising 16 common connected cathode groups are used, the decoder 22 of FIG. 7 should be the one having four input terminal and 16 output terminals, the selector 21 should have four input terminals and four output terminals and the binary counter 20 should have four output terminals.

Figure 3:
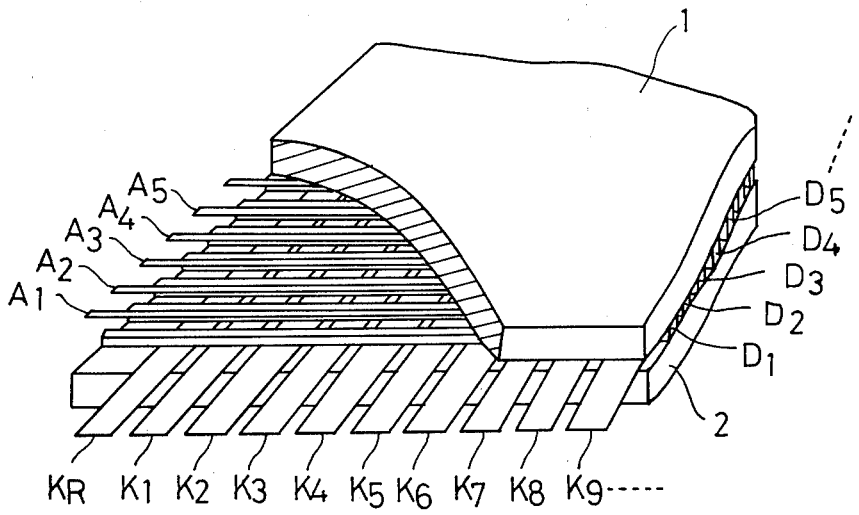
FIG. 3 is a fragmental perspective view of a gas discharge display device, which has been developed by the same inventors, but not yet published at the date of the convention priority date (July 14, 1978) of the present application.
Figure 4:
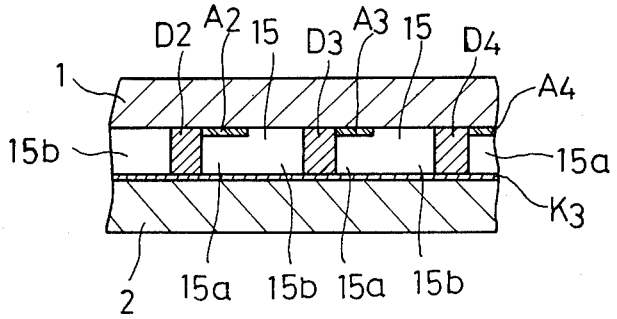
FIG. 4 is an enlarged partial sectional view of the device of FIG. 3.

A further embodiment of the present invention is made by utilizing a gas discharge display panel described and shown in FIG. 3 and FIG. 4 in the Japanese patent application Sho 52-58262. The abovementioned display panel is shown in FIG. 3. FIG. 3 is a fragmental perspective view of another example and FIG. 4 is a sectional view of a part thereof. The device has a kind of anode, contradistinctively from two kind of anodes of Burrough's device. The device has a pair of glass plates 1 and 2 disposed parallel to a specified gap space inbetween. In the gap space, there are provided a number of parallel stripe shape conductor films $K_R$, $K_1$, $K_2$, . . . as cathodes and a number of parallel strip shape conductor films $A_1$, $A_2$, $A_3$, . . . as anodes, in a manner that the cathodes and the anodes cross over each other at right angles and with a specified gap at each crossing portion. Dielectric barriers $D_1$, $D_2$, $D_3$, . . . are provided along and between neighboring anodes so that anodes are disposed in an oblong groove 15 defined by the dielectric barriers. The stripe shaped films of anodes are formed to be about 20 μm thick by a paste of synthetic resin containing silver powder as conductor. The stripe shaped films of cathodes are formed about 20 μm thick by a paste of synthetic resin containing nickel powder as a conductor. Each of the discharge cells in the groove 15 is divided into two parts, namely a first part 15*a* having one of the stripe shaped anodes $A_1$, $A_2$, $A_3$, . . . and a second part 15*b* which does not have the stripe shaped anodes.

When the effective discharge current is small, namely in light-off states which are for transferring a glow along the anode in the cell, the glow dischargings take place only in the first part, so that the scanning glow is covered by the stripe shaped anode. When the effective discharge current is large, namely in the light-on state which is for displaying with larger glow discharge light, the glow discharging expands to both of the first part and the second part, so that the displaying glow is clearly noticeable through the upper (i.e., front) glass panel 1. Thus, by changing the value of the discharge current, the display can be made with a satisfactory contrast.

The following Table 4 shows details of the construction and performance of the device of FIG. 3 and FIG. 4, which is operated by the circuit connections of FIG. 5(*a*) and FIG. 7, in principle. However, in the actual device of the embodiment, the number of the common connection cathode groups is 16.

TABLE 4

| Device of FIGS. 3, 4, 5 and 7 | |
|---|---|
| number of cathodes | 96 (divided into 6 common connected cathode groups) |
| number of anode | 36 |
| pitch of the discharge dots | 1.27 mm |
| discharge gaps between cathodes and anodes | 0.3 mm |
| discharge gas | (Ne + 0.5% Ar), 150 Torr. |
| color of display light | orange |
| ignition voltage between anode and cathode | 250 V |
| display discharge current | 0.8 mA |
| discharge sustain voltage | 160 V |
| brightness of displaying | about 50 fL |
| duty for scanning in display discharging | $\frac{1}{100}$ |

Figure 8:
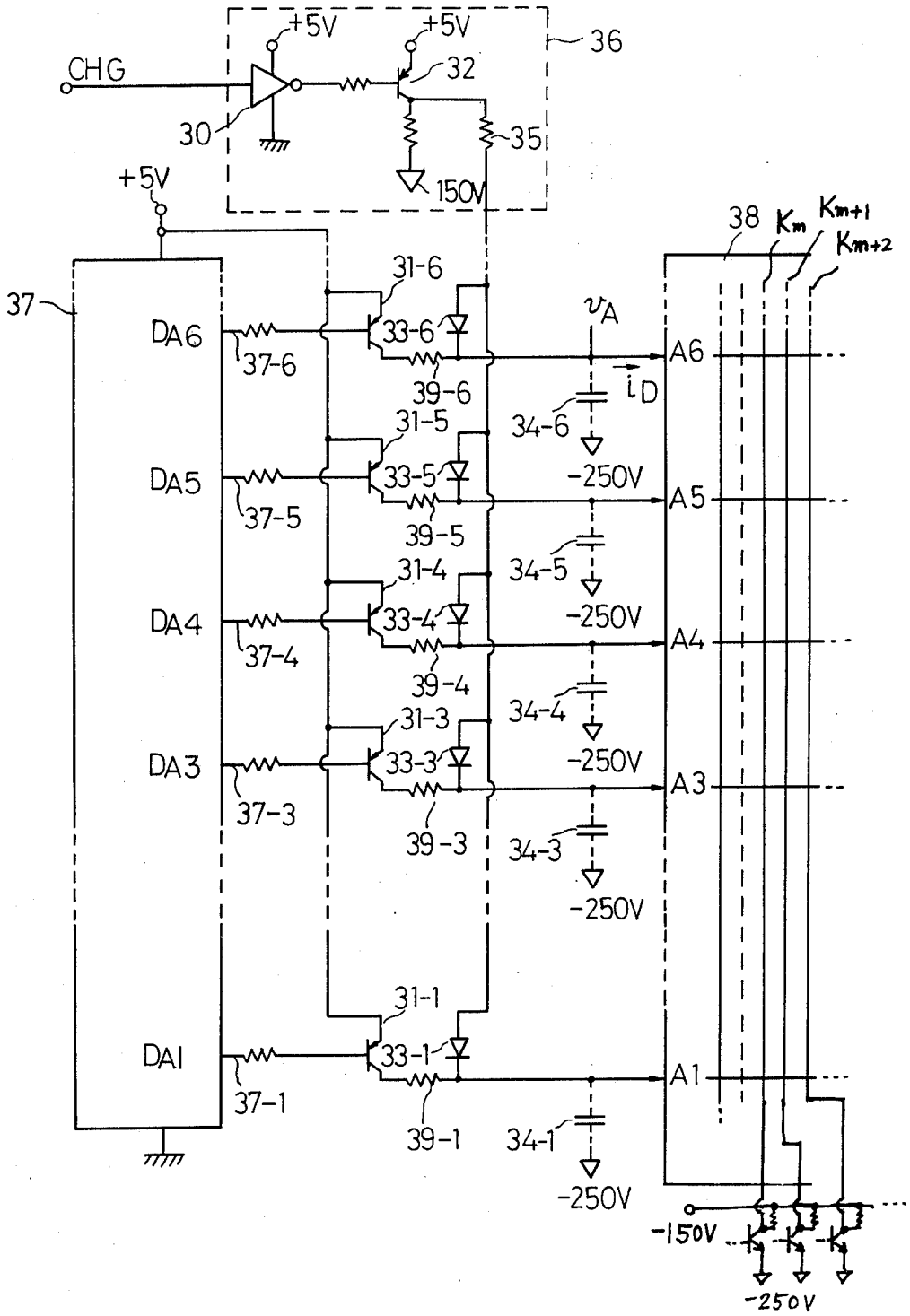
FIG. 8(*a*) is a circuit diagram of another driving circuit which has been developed by the same inventors, but not yet published at the date of the convention priority date of the present application.
Figure 8:
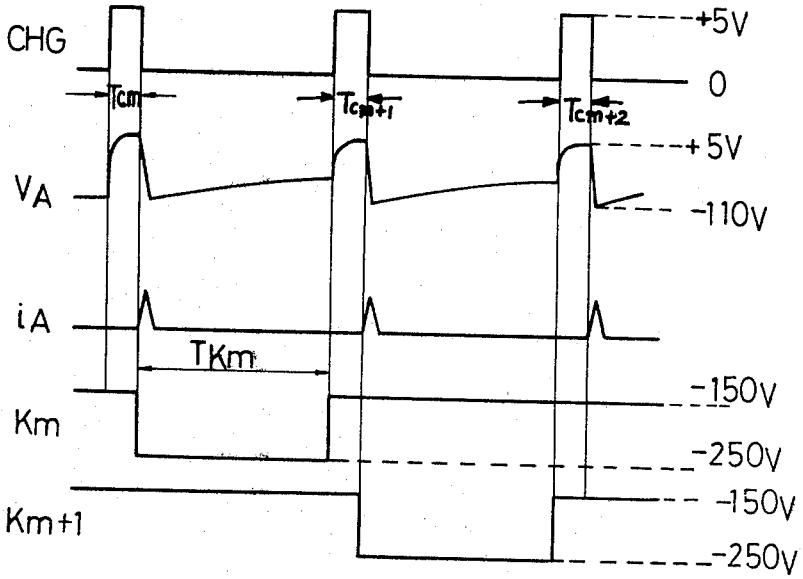

FIG. 8(*a*) shows one example of a scanning circuit which is applied to the gas discharge display device of the present invention, which enables high contrast ratio between light-on state and light-off state as well as stable and flicker-free display. The circuit of FIG. 8(*a*) is the circuit described in the Japanese patent application Sho 52-139335 and FIG. 8(*b*) is a timing chart showing waveforms of various parts of the circuit of FIG. 8(*a*). This circuit gives charges to capacitances 34-1 . . . , 34-6, of anodes $D_{A1}$, . . . $D_{A6}$, in turn prior to their respective scanning by the anodes. Then, the charges are discharged by the impressings of scanning pulses on cathodes, thereby making scanning of the gas discharge along the anode.

The details are as follows. In the circuit of FIG. 8(*a*), an anode control circuit 37 parallelly gives individual signals from the output terminals $D_{A1}$, . . . $D_{A6}$ . . . to the bases of switching transistors 31-1, . . . , 31-6, . . . the collectors of which transistors are connected through resistors 39-1, . . . , 39-6, . . . to the anodes $A_1$, . . . $A_6$, . . . , of the display device 38, respectively. To the circuit of the anodes $A_1$, . . . $A_6$ . . . , capacities 34-1, . . . , 34-6, . . . are connected with their one ends and the other ends thereof are connected in common to a negative terminal −250 V of a D.C. source which feeds the voltage of −250 V. The capacities can be either capacitors of specified capacitance or stray capacities (for example, about 30 pF) of the anode circuits. A charging signal terminal CHG gives a charging control signal to the control terminal of a TTL inverter 30, of a charging circuit which gives output signal to the base of a charging transistor 32. The collector of the charging transistor 32 is connected, through a resistor 35 and through respective diodes 33-1, . . . , 33-6, . . . to the anodes $A_1$, . . . $A_6$, . . . . Also the collector of the charging transistor 32 is connected through a resistor to a terminal −150 V which feeds the D.C. voltage of −150 V.

When all of switching transistors 31-1, . . . , 31-6, . . . are made OFF, thereby making all of the discharging dots in light-off state, i.e., a glow scanning state, then the signal at the charging signal terminal CHC is made "H" (high level) for a specified short period Tcm before the beginning of each period of impressing −250 V to the cathode, as shown in curve (CHG) of FIG. 8(*b*). Therefore, the TTL inverter 30 gives inverted pulse signal to the transistor 32 thereby making it ON during the "H" of the terminal CHG for the short period Tcm. Accordingly, the capacities 34-1, . . . , 34-6, . . . are charged by currents flowing for the short time period Tcm through the diodes 33-1, . . . , 33-6, . . . respectively, thereby raising the potential of the anodes to +5 V, which is fed from a terminal +5 V connected to the emitter of the transistor 32. Incidentally, when the charging signal is "L" (low level), the transistor 32 is made OFF, and therefore, the potential of −150 V is applied to the anodes of the diodes 33-1, . . . , 33-6, . . . thereby making these diodes OFF.

When the capacities 34-1, . . . , 34-6, . . . are charged up to +5 V, then a selected cathode is controlled to become −150 V.

Since the capacities 34-1, . . . , 34-6 are charged to give the potential of +5 V to the anodes, when the voltage of −250 V is applied to one cathode of the display device 38 the voltage between the anode and the cathode of the device 38 becomes 255 V, and hence, this 255 V makes a display discharging take place. The transistors 31-1, . . . , 31-6, . . . are made OFF at this time and the transistor 32 is made OFF after the period of Tcm, and therefore, only the charges in the capacities 34-1, . . . , 34-6, . . . flows into the cell of the discharge device 38. Since amounts of the charges of the capacities are very small, the value of integral of the discharge current with respect to time is very small. Accordingly, the discharge current ceases in a very short time, and the effective intensity of the glow light is also very weak. Namely, no noticeable displaying is made, but a transfer of glow only is made as shown in the waveform ($i_A$) of FIG. 8(*b*). The potential of −250 V is still applied to the selected cathode, and therefore, when the anode potential falls down from the abovementioned +5 V to −110 V, the anode-cathode voltage difference is lowered to 140 V, and then, this lowered 140 V makes the discharging cease as a result of lowering of the anode-cathode voltage difference. Thereafter, the capacities 34-1, . . . , 34-6, . . . are again charged by small cut-off currents of the collector of the transistors 31-1, . . . , 31-6, . . . and the voltages of the capacities slowly rise up, and then, when the charging signal at the terminal CHG comes to the next pulse shown by $T_{cm+1}$ of the waveform (CHG) of FIG. 8(*b*), the anode potential rises to +5 V. Then, when the potential of −250 V is applied to the next cathode, the voltage between the anode and the cathode becomes 255 V, and another scanning glow discharge takes place between the anode and the cathode. Since the amounts of the charges of the capacities 34-1, . . . , 34-6 are very small, the value of discharge current integrated with respect to time is very small, and the effective intensity of the glow light is also very weak, and therefore no noticeable light is produced, but only a transfer of glow (scanning) is made.

In the similar manner, the scanning i.e., transfers of scanning glow are made in sequence along the anode. Since the discharging for scanning is made by charges of the small capacities 34-1, . . . , 34-6, . . . , the effective currents or integral values of current with respect to time are very small for the scanning, and hence, the scanning produces no noticeable light. Since one scanning discharge is necessarily made within each time period $T_{Km}$ of cathode scanning shown in FIG. 8(*b*) ($i_A$), the transfer of the glow is very stable and no unpleasant flickering takes place. The anode control circuit 37 issues control signals in sequence from its output terminals $D_{A1}$, . . . , $D_{A6}$, . . . to the bases of the anode driving transistors 31-1, . . . , 31-6, . . . so that light-ons and light-offs at selected parts in discharge cells along the anode are made by the control signals.

When the charging signals at the terminal CHG is "H" during the charging periods Tcm, Tcm+1, Tcm+2, . . . , the capacities 34-1, . . . , 34-6, . . . are charged as elucidated already referring to FIG. 8(*b*), and hence, the potentials $V_A$ of all anodes rises to +5 V as shown by the waveform $V_A$ of FIG. 8(*b*).

When the anode potential $D_{A1}$ is "L", the anode driving transistor 31-1 becomes on, thereby allowing a large displaying discharge current $i_A$ of, for example, 0.6 mA to flow from the leftmost +5 V terminal through the emitter and collector of the transistor 33-1 and through the resistor 39-1 to the anode $A_1$, thereby producing a bright glow at the discharging dot.

On the other hand, when the anode potential $D_{A1}$ is "H," the anode driving transistor 31-1 becomes off, thereby changing the operation into the scanning.

The abovementioned scanning circuit utilizing the pulsative discharges of the charges in the capacities shows a high contrast of display since scanning discharge current is small.

When conventionally connected display panel is operated with the abovementioned scanning circuit utilizing the pulsative signals, maloperations of scanning are considerably observed. However, when the abovementioned scanning circuit with the pulsative signals is applied to the gas discharge display device of the present invention, very stable scanning is attained.

As a result, it is confirmed that the gas discharge display device in accordance with the present invention is especially suitable for the aforementioned display panel proposed by the same inventors.

What is claimed is:

1. A gas discharge display device comprising an array of a number of parallel disposed anodes and an array of a number of parallel disposed cathodes said anodes and said cathodes being disposed crosswise with small discharging gaps filled with gas therebetween, thereby forming a gas discharging matrix having a number of gas discharging cells thereon at cross points of said anodes and said cathodes, wherein a discharging spot scans from a cell at one end of said gas discharging cells to a cell at the other end thereof by being transferred sequentially from one discharge cell to the next one, wherein the cathodes are divided into a plurality of sub-arrays disposed in sequence from one side to the other side of the cathode array, each cathode in a sub-array being commonly connected to a cathode in the other respective sub-arrays, thereby forming a plurality of groupings of commonly-connected cathodes, and the improvement is that adjacent cathodes in any one of the sub-arrays are respectively commonly connected to non adjacent cathodes in the others of the sub-arrays.

2. A gas discharge display device in accordance with claim 1, wherein the cathodes are connected to receive scanning signals given by a circuit including a binary counter, a selector which issues output signals from said binary counter to its selected output terminals and a decoder which is connected by input terminals thereof to the other output terminals of said selector.

3. A gas discharge display device in accordance with claim 1 or 2, wherein said discharging gaps are in a closed space, said closed space being divided into rows of discharging cells by dielectric barriers disposed along said anodes, said discharging cells being disposed along said anodes, and said anodes and said cathodes being connected to a driving circuit which gives said electrodes in sequence a first kind of signals which cause stronger dischargings for displaying and a second kind of signals which cause weaker dischargings for scanning, both dischargings being made between the same pair of said anodes and said cathodes.

* * * * *